US006239391B1

(12) United States Patent
Nishijima et al.

(10) Patent No.: US 6,239,391 B1
(45) Date of Patent: May 29, 2001

(54) KEYBOARD ASSEMBLY HAVING HIGHLY WATERPROOF KEY SWITCHES

(75) Inventors: Akio Nishijima; Hideki Ito, both of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/588,138

(22) Filed: Jun. 2, 2000

(30) Foreign Application Priority Data

Apr. 6, 1999 (JP) ..... 11-158770

(51) Int. Cl.[7] ..... H01H 13/70

(52) U.S. Cl. ..... 200/5 A; 200/302.2; 200/344

(58) Field of Search ..... 200/5 A, 512, 200/517, 302.1, 302.2, 341, 344, 345; 400/490, 491, 491.2, 495, 495.1, 496

(56) References Cited

U.S. PATENT DOCUMENTS 4,636,593 * 1/1987 Novak et al. ..... 200/5 A
5,117,076 * 5/1992 Damitio ..... 200/344
5,642,950 * 7/1997 Hochgesang et al. ..... 400/490
5,734,136 * 3/1998 Newcomer et al. ..... 200/5 A
5,794,762 8/1998 Tsai ..... 200/343
6,057,522 * 5/2000 Chao ..... 200/344

* cited by examiner

*Primary Examiner*—Michael Friedhofer
(74) *Attorney, Agent, or Firm*—Brinks Hofer Gilson & Lione

(57) ABSTRACT

In the keyboard assembly, post-like support members are formed sideways of each of the key top housings corresponding to key tops to which torsion bars are attached respectively, out of plural key top housings, the support members being erected integrally from a housing plate and having a hollow structure, through holes are formed respectively in base end portions of the support members so as to extend through the housing plate, and a sheet member is disposed on a back side of the housing plate, the sheet member comprising waterproofing protuberances for closing the through holes in a waterproof manner, spring portions for pushing back the key tops upward, and a sheet body portion which renders the spring portions and the waterproofing protuberances integral with each other.

6 Claims, 6 Drawing Sheets

KEYBOARD ASSEMBLY HAVING HIGHLY WATERPROOF KEY SWITCHES

BACKGROUND OF THE INVENTION

1. Field of the Invention

The present invention relates to a keyboard assembly having an improved waterproof structure of a torsion bar receiving portion in each key switch provided with the torsion bar.

2. Description of the Related Art

On a keyboard of a computer or a word processor are arranged a large number of key switches 100, for example like a keyboard B shown in FIG. 7. Key tops are attached respectively to the key switches 100 so as to be pushed by a user's finger. The key tops are in various planar shapes, including a generally square shape, a half-cut shape thereof, a sideways long shape, and a deformed L shape.

As shown in FIG. 8, the key switches are each generally composed of a key top 110 and a key switch body 120. The key top 110 comprises a top plate 111 to be pushed with a finger, a cylindrical stem portion 112 extending downward through an axis X of the key top from a lower surface of the top plate 111, pawl portions 113 formed downwards on both sides of the stem portion 112, and a skirt wall 114 extending downward from a peripheral edge portion of the top plate 111.

The key switch body 120 comprises a housing 121 which houses the key switch body 120 therein, an inverted bowl-shaped rubber spring 122 connected to a lower end of the stem portion 112, and a membrane switch 124 disposed below a convex-shaped pressing portion 123 which is formed centrally downward from a top part of the rubber spring 122. The housing 121 is formed with a cylindrical socket 125 into which the stem portion 112 is inserted vertically slidably and is also formed with pawl engaging holes 126 for engagement with the pawl portions 113 to prevent extraction of the key top 110 from the key switch body 112.

In the key switch of the above configuration, when the top plate 111 of the key top is pushed by a user's finger, as shown in FIG. 9, the stem portion 112 slides downwards through the socket 125 and a lower end thereof pushes the rubber spring 122 downward, causing the rubber spring to buckle. As a result, the pressing portion 123 of the rubber spring pushes the membrane switch 124 and causes the membrane switch to turn conductive. Upon release of the user's finger from the top plate 111, the key top 110 reverts to its original position with a repulsive force of the rubber switch 122, so that the membrane switch 124 turns OFF.

In each of the switches 100 of the above keyboard, key tops 110A of such keys as shift key, space key, and tab key are each provided with a sideways long top plate 111 as in FIG. 10, but the shape, position and size of the stem portion 112 are set equal to those in a sectional key switch structure shown in FIG. 8. Therefore, what is called a torsion bar, as a spring member, is incorporated in the key top so that the top plate 111 can be smoothly depressed right beneath even when it is depressed on an end side thereof.

The torsion bar, indicated at 130, comprises a body portion 130*a* which is in a rectilinear shape and hook portions 130*b* extending in an inward L shape from both ends of the body portion. The body portion 130*a* is fitted in and engaged with support members 129 formed on the back side of the top plate 111 and is thus retained on the back side of the top plate. A pair of post-like support projections 131 of a hollow structure are erected on both sides of the housing 121, with support holes 131*a* being formed in upper portions of the support projections 131, respectively. The hook portions 130*b* of the torsion bar 130 are engaged respectively in the support holes 131*a,* whereby the torsion bar 130 is locked. With the torsion bar 130 thus locked, the stem portion 112 is inserted into the socket 125. In this way the key tops 110A of such keys as shift key, space key, and tab key are mounted onto the keyboard.

Drink cans or cups or the like may be placed on a table around the keyboard of this type and therefore it is considered preferable for the keyboard to have a waterproof structure.

Reference will now be made to a water entry route for an electric circuit portion of each membrane switch 124 in the interior of the keyboard. In each key switch 100 of the structure shown in FIGS. 8 and 9, water may enter the interior of the keyboard through the opening portions of the socket 125 and the pawl engaging holes 126. However, since those opening portions are covered with the skirt wall 114 of the key top 110, it is considered that a high waterproofness is ensured.

However, in the key top 110A of, for example, a shift key or a space key having the torsion bar 130 shown in FIG. 10, the retaining holes 131*a* formed in the support projections 131 for retaining the hook portions 130*b* of the torsion bar 130 are positioned on end sides of the key top 110A, so the opening portions of the retaining holes 131*a* may be a cause of water entry. In more particular terms, the support projections 131 are of a hollow structure and an electric circuit which constitutes the membrane switch 124 is provided below the support projections 131, therefore, if water should enter the interior through the retaining holes 131*a* of the support projections 131, there is a fear that the electric circuit of the membrane switch 124 may be corroded or damaged.

If the support projections 131 are formed not as a hollow structure but as a solid post-like structure and if bent portions for retaining the hook portions 130*b* of the torsion bar 130 are formed on end sides of the support projections respectively, it is required that the support projections 131 be formed in L shape. However, in forming the keyboard by molding a resin, if a plurality of solid L-shaped structures are erected about a housing plate in the keyboard, there arises the problem that the shape of a mold for molding the keyboard housing plate becomes complicated. More particularly, in the structures shown in FIGS. 8, 9 and 10, the portion of the socket 125, the portion of each pawl engaging hole 126, and the portion of each support projection 131 are each of a vertically through structure, so it is easy to design a mold in case of molding the keyboard assembly with use of both upper and lower mold halves, but if a structure having L-shaped support members not of a through structure on an upper surface of the housing plate is to be formed by molding with use of upper and lower mold halves, the mold becomes complicated in shape and difficult to design.

SUMMARY OF THE INVENTION

With the foregoing as background, it is an object of the present invention to provide a keyboard assembly in which the portions around keys each having a torsion bar such as shift key, space key, and return key are rendered highly waterproof.

According to the present invention, which has been accomplished in view of the above-mentioned circumstances, there is provided, in the first aspect thereof, a keyboard assembly characterized in that a plurality of key top housings for supporting key tops are formed on a housing plate disposed below the key tops, post-like support members are formed sideways of each of the key top housings corresponding to key tops to which torsion bars are attached respectively, out of the plural key top housings, the support members being erected integrally from the housing plate and having a hollow structure, through holes are formed respectively in base end portions of the support members so as to extend through the housing plate, and a sheet member is disposed on a back side of the housing plate, the sheet member comprising waterproofing protuberances for closing the through holes in a waterproof manner, spring portions for pushing back the key tops upward, and a sheet body portion which makes the spring portions and the waterproofing protuberances integral with each other.

Since the through holes formed in the housing plate under the support members at a position corresponding to each of the key tops with torsion bars attached thereto respectively are closed with the waterproofing protuberances of the sheet member, it is possible to enhance the waterproofness of the portion around each of the associated keys.

According to the present invention, in the second aspect thereof, there is provided a keyboard assembly comprising a support plate, membrane switches formed on the support plate, a housing plate disposed on the membrane switches, and key tops respectively supported vertically movably on a plurality of convex-shaped key top housings, the key top housings being arranged in rows on an upper surface side of the housing plate, wherein a torsion bar is attached to a back side of at least one of the key tops, support members of a hollow structure are erected on the housing plate on both sides of the key top housing which supports the key top with the torsion bar attached thereto, retaining holes for retaining end portions of the torsion bar are formed respectively in upper portions of the support members, while on bottom sides of the support members are respectively formed through holes which extend through the housing plate and which are open to a bottom side of the housing plate, and a sheet member is disposed between the housing plate and the membrane switches, the sheet member comprising convex-shaped spring portions aligned respectively with the plural key top housings, convex-shaped waterproofing protuberances positioned respectively in the opening portions of the through holes formed in the housing plate to close the opening portions, and a sheet body portion which renders the plural spring portions and the plural waterproofing protuberances integral with each other.

Since the through holes formed in the housing plate under the support members are closed with the waterproofing protuberances of the underlying sheet member, it is possible to enhance the waterproofness of the surrounding portions of the keys. Besides, the sheet member is a single sheet comprising the spring portions, the waterproofing protuberances, and the sheet body portion and it covers the member switches from above, so it is possible to completely prevent the entry of water from the key top side to the membrane switch side.

In the third aspect of the present invention, the waterproofing protuberances have a planar shape larger than the opening portion of each of the through holes so that they can each cover the whole of the opening portion.

Since the waterproofing protuberances are each larger than the opening portion of each through hole, it is possible to cover the through hole completely and hence possible to enhance the waterproofness.

In the fourth aspect of the present invention, the key top housings are of a hollow structure and their hollow portions are contiguous respectively to insertion holes formed in the housing plate, and the spring portions of the sheet member pass respectively through the insertion holes and are inserted into the key top housings, the spring members imparting an upward reverting force to the key tops.

The spring portions, when depressed by the key tops, press the membrane switches, causing the key switches to turn conductive. The spring portions of the sheet member are inserted into the housing and cause the associated key tops to revert upward to their original position when depressed by a user's finger.

In the fifth aspect of the present invention, the spring portions are formed as rubber spring portions, and the rubber spring portions, the waterproofing protuberances, and the sheet body portion are rendered integral with one another using the same rubber.

Since the rubber spring portions and the waterproofing protuberances are formed using the same rubber, the waterproofing protuberances can close the opening portions of the through holes in the housing plate completely in close contact with the opening portions, thus enhancing the waterproofness.

DETAILED DESCRIPTION OF A PREFERRED EMBODIMENT

An embodiment of the present invention will be described in detail hereinunder with reference to the accompanying drawings, but it is to be understood that the invention is not limited thereto.

Figure 1:
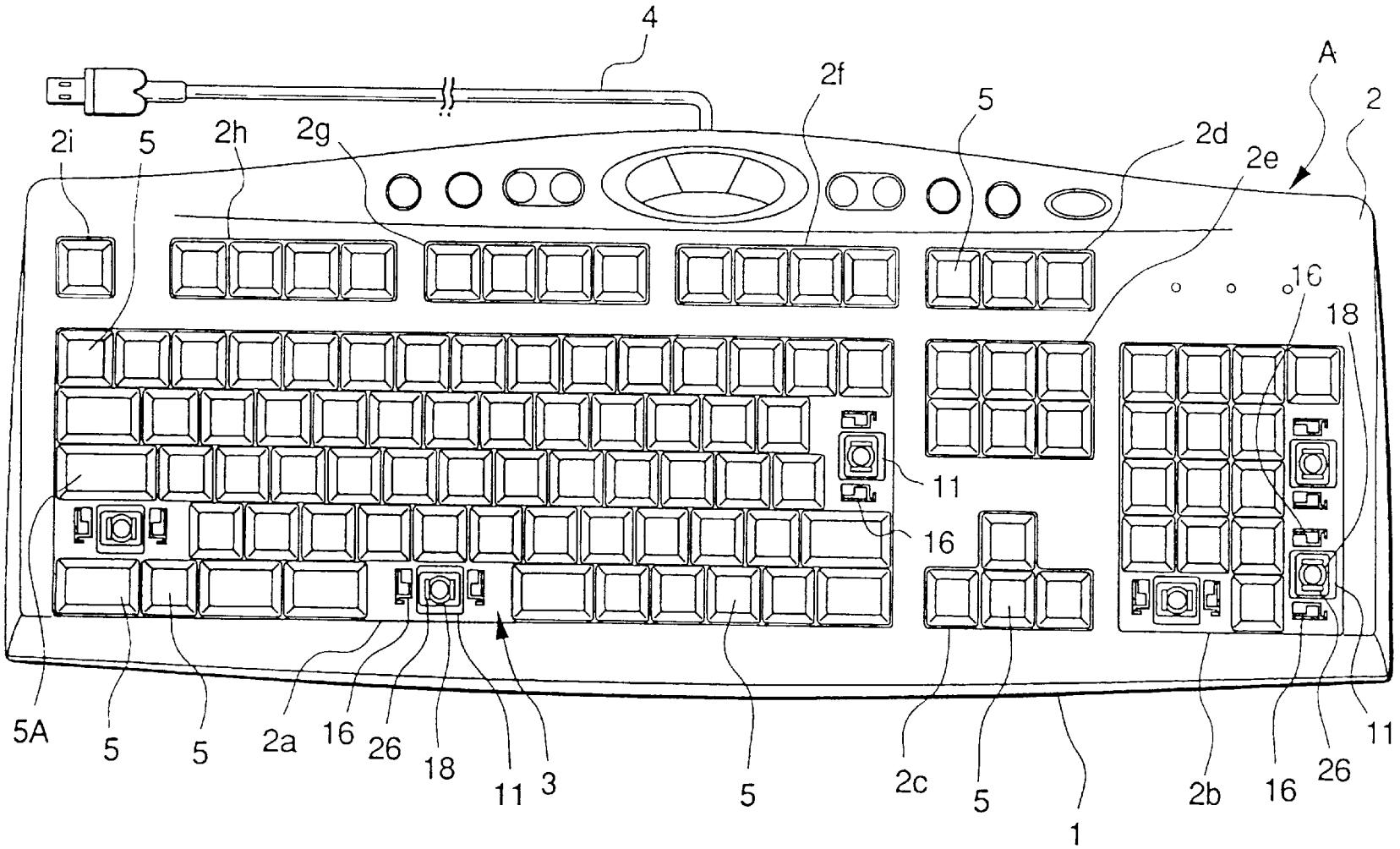
FIG. 1 is a perspective view of a keyboard assembly according to the first embodiment of the present invention.
Figure 2:
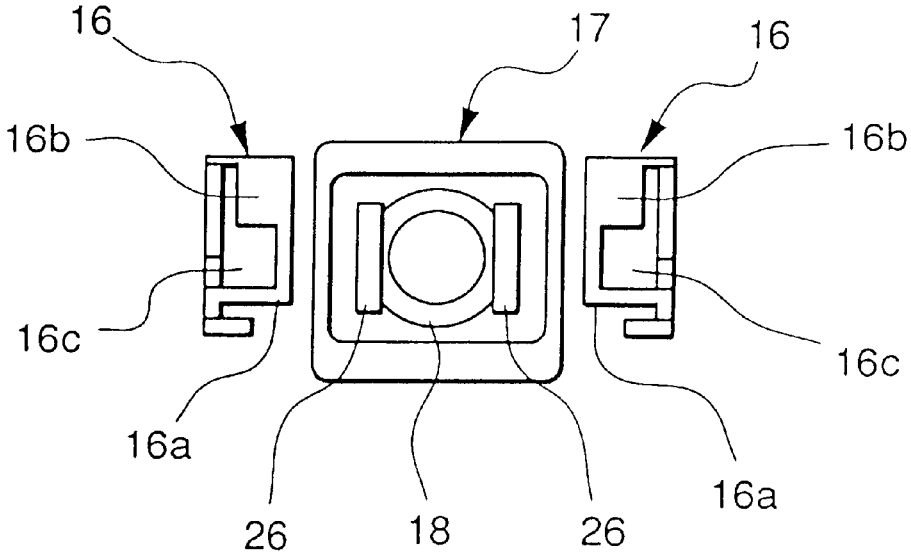
FIG. 2 is an enlarged view showing an example of a key top housing used in the first embodiment illustrated in FIG. 1.

FIG. 1 shows a keyboard assembly embodying the present invention. The keyboard assembly, indicated at A, is mainly composed of a lower case 1, an upper case 2, a keyboard body 3 received between both cases, and a connecting cable 4 connected to the keyboard body 3 and drawn out to the exterior of the cases for connection to a control device such as a personal computer.

The keyboard body 3 is provided on an upper surface thereof with a large number of key tops 5, the key tops 5 being arranged in a projected state to the exterior through window portions 2*a*, 2*b*, 2*c*, 2*d*, 2*e*, 2*f*, 2*g*, 2*h*, and 2*i* which are formed in an upper surface of the upper case 2. The window portion 2*a* is an area in which main keys such as alphabet keys in the keyboard body 3 are arranged. The window portion 2*b* is an area in which 10-numeric keys are arranged. The window portion 2*c* is an area in which arrow keys are arranged. The window portions 2*d*, 2*f*, 2*g*, 2*h*, and 2*i* are areas in which function keys are arranged. The window portion 2*e* is an area in which DEL key and INS key are arranged.

Figure 3:
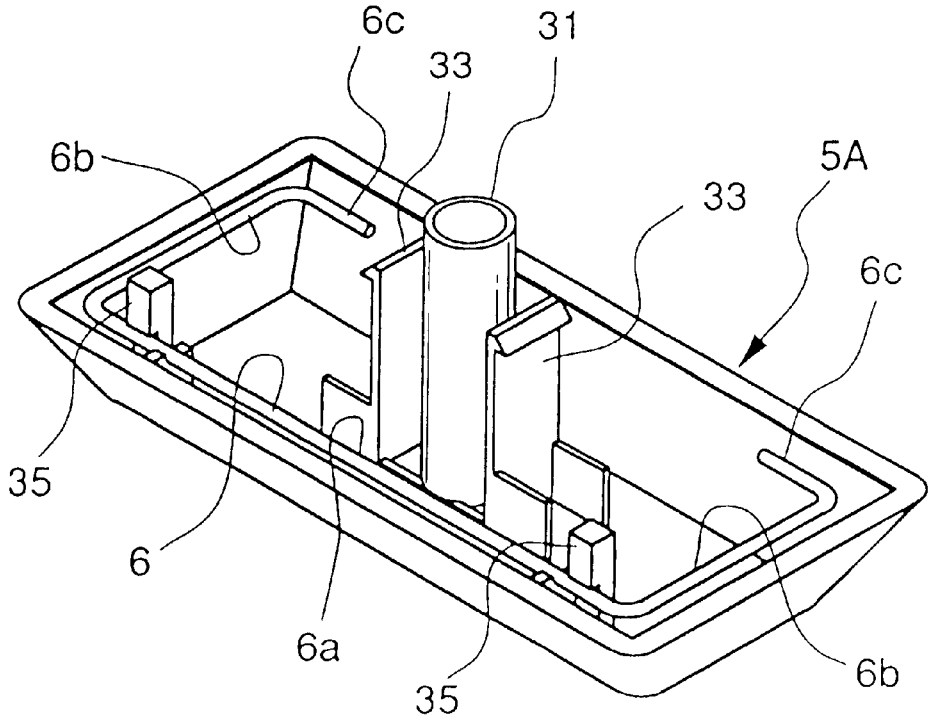
FIG. 3 is a perspective view showing a key top attached to the key top housing.
Figure 4:
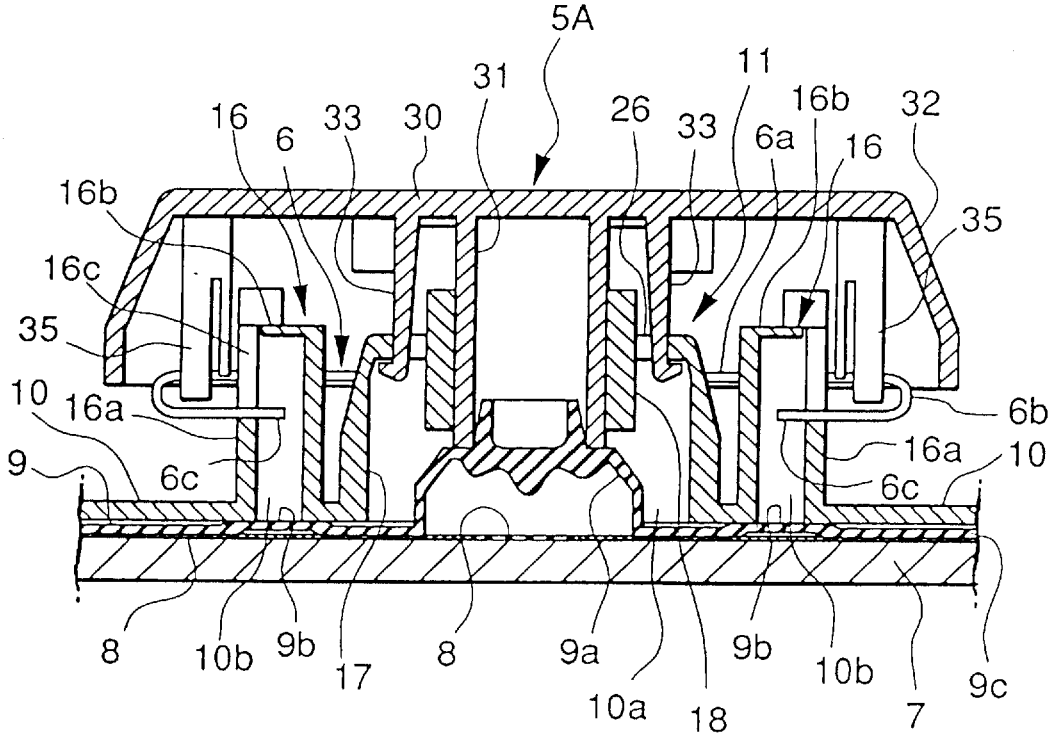
FIG. 4 is a sectional view showing a state in which the key top illustrated in FIG. 3 has been attached to the key top housing illustrated in FIG. 2 and also showing a sheet member and a membrane switch both disposed below the key top.

Among the many key tops 5, plural key tops 5A of such keys as shift keys, space key, and return key are formed sideways long or larger in size than the other key tops 5 and with a torsion bar 6 (see FIGS. 3 and 4) to be described later being attached to the back side of each key top 5A. The other key tops 5 are formed in a rectangular shape close to a square shape in plan and are not provided with the torsion bar 6.

An inner support plate 7 (see FIGS. 4 and 5), which is a metallic plate or the like, is disposed between the lower case 1 and the upper case 2, sheet-like membrane switches 8 are disposed on the inner support plate 7, and a sheet member 9 is disposed on the membrane switches 8. Further, a housing plate 10 is disposed on the sheet member 9 so as to constitute bottoms of the window portions 2*a*~2*f* formed in the upper case 2 and is bonded integrally to the upper case 2. On an upper surface of the housing plate 10 are provided projection-like key top housings 11 to match the positions of the key tops 5. On both sides of each of the key top housings 11 located at the positions of a shift key, a space key, and a return key, or at several other positions in addition to those positions, out of the plural key top housings 11, there are formed support members 16 to be described later in a sandwiching relation to the key top housing 11.

The key top housing 11 is configured as follows. First, on the upper surface of the housing plate 10 are formed prismoid-shaped housing projections 17 correspondingly to the positions where the key tops 5 and 5A are provided and projectingly from the housing plate 10 each individually. A cylindrical inserting portion 18 is formed centrally in each housing projection 17 and slit-like pawl engaging holes 26 are formed on both sides of the inserting portion 18. Further, under the portion where each housing projection 17 is formed there is formed a through hole 10*a* extending through the housing plate 10.

Each key top 5 comprises a top plate 20 of a rectangular shape close to a square shape in plan, a cylindrical stem portion 21 suspended centrally from a lower surface of the top plate 20, a skirt wall 22 extended from a peripheral edge portion of the top plate 20, and pawl portions 23 extended on both sides of the stem portion 21 from the lower surface of the top plate.

Figure 5:
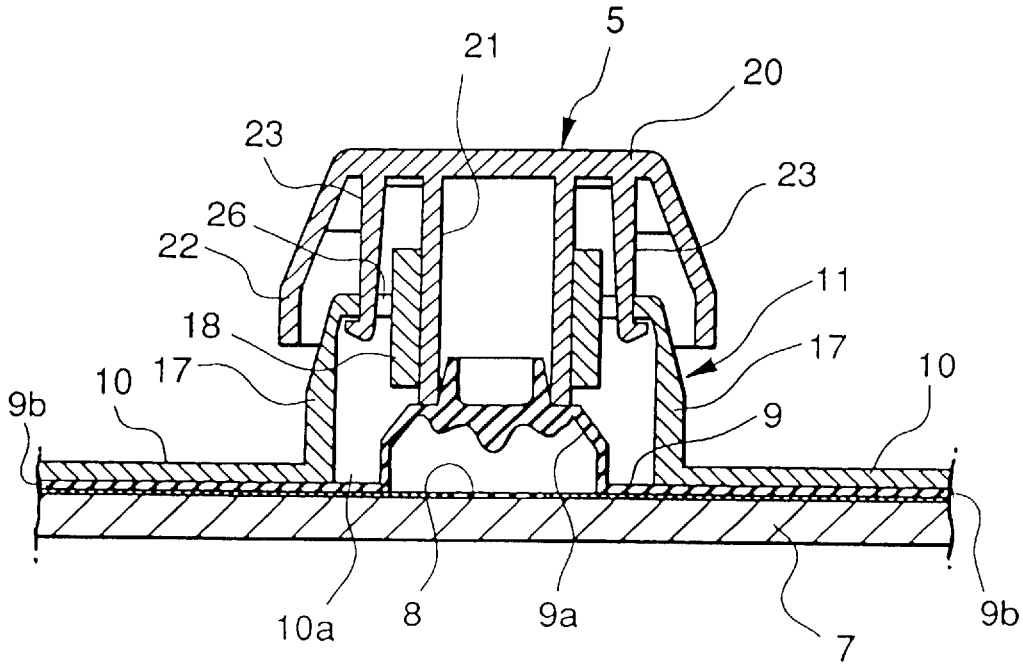
FIG. 5 is a sectional view showing a depressed state of the key top in the structure illustrated in FIG. 4.

As shown in FIG. 5, each key top 5 is mounted on the associated key top housing 11 vertically movably in a state in which its stem portion 21 is inserted into the inserting portion 18 and its pawl portions 23 inserted into the pawl engaging holes 26 to prevent dislodgment of the key top from the key top housing.

The key top 5A corresponding to a shift key or a space key comprises a top plate 30 which is in a sideways long rectangular shape in plan, a cylindrical stem portion 31 suspended centrally from a lower surface of the top plate 30, a skirt wall 32 extended from a peripheral edge portion of the top plate 30, and pawl portions 33 extended on both sides of the stem portion 31 from the lower surface of the top plate. Further, under the portion where each housing projection 17 is formed there is formed a through hole 10*a* through the housing plate 10.

The key top 5A is provided with a torsion bar 6 which is supported by a pair of support pieces 35 formed on a back side of part of the skirt wall 32. The torsion bar 6, which is formed by bending a metallic bar, comprises a rectilinear body portion 6*a* and L-shaped bent portions 6*b* extended approximately at right angles from both ends of the body portion 6*a*. Extremities 6*c* of both bent portions 6*b* confront each other. The body portion 6*a* of the torsion bar 6 is engaged with the support pieces 35 which are located inside the skirt wall 32. In this state the torsion bar 6 is supported inside the skirt wall 32 so as to be pivotable about the body portion 6*a*.

Prismatic support members 16 of a hollow structure are erected respectively on both right and left sides of the key top housing 11 provided with the torsion bar 6. Each support member 16 is made up of a prismatic, hollow support post portion 16*a* erected integrally from the key top housing 11, a top plate member 16*b* form on top of the support post portion 16*a*, and a retaining hole 16*c* formed in the top plate member 16*b*. On a base end side of each support member 16 a through hole 10*b* is formed in the housing plate 10, the through hole 10*b* being open to a back side of the housing plate 10 so as to communicate with the hollow portion of the support member 16.

The extremities 6*c* of the torsion bar 6 are inserted into the retaining holes 16*c* of both support members 16, allowing the torsion bar 16 to be engaged with upper end sides of the support members 16. Further, the stem portion 31 is inserted vertically movably into the inserting portion 18. In this way the key top 5A is mounted to the key top housing 11 in a vertically movable manner.

The sheet member 9 disposed between the membrane switches 8 and the housing plate 10 is made up of domed (rubber) spring portions 9*a* extending respectively inwards of the key top housings 11 described previously through the insertion holes 10*a* formed below the key top housings 11, convex-shaped waterproofing protuberances 9*b* each having a flat surface and capable of closing the through holes 10*b* formed on the base end sides of the support members 16, and a sheet body portion 9*c* which renders the spring portions 9*a* and the waterproofing protuberances 9*b* integral with each other. The sheet member 9 is a single sheet formed of a soft resin such as rubber having a moderate elasticity throughout the whole of the sheet member.

The sheet member 9 is sandwiched between the membrane switches 8 and the housing plate 10 in such a manner that the spring portions 9*a* are projected inside the key top housings 11 and that the waterproofing protuberances 9*b* are pushed against bottom openings of the through holes 10*b* and also against the surrounding portions. The waterproofing protuberances 9*b* are each formed in a circular shape in plan which is larger in outside diameter than each through hole 10*b* so as to cover the through hole 10*b* completely. With the sheet member 9 sandwiched between the inner support member 7 and the housing plate 10, the waterproofing protuberances 9*b* are pushed and deformed against the opening portions of the through holes 10*b* respectively, so that the opening portions of the through holes are closed completely by the waterproofing protuberances 9*b*. The waterproofing projections 9*b* may be in any planar shape, but it is preferable that the waterproofing projections 9*b* be larger in external form than the through holes 10*b* so as to permit complete closing of the opening portions of the through holes.

Figure 6:
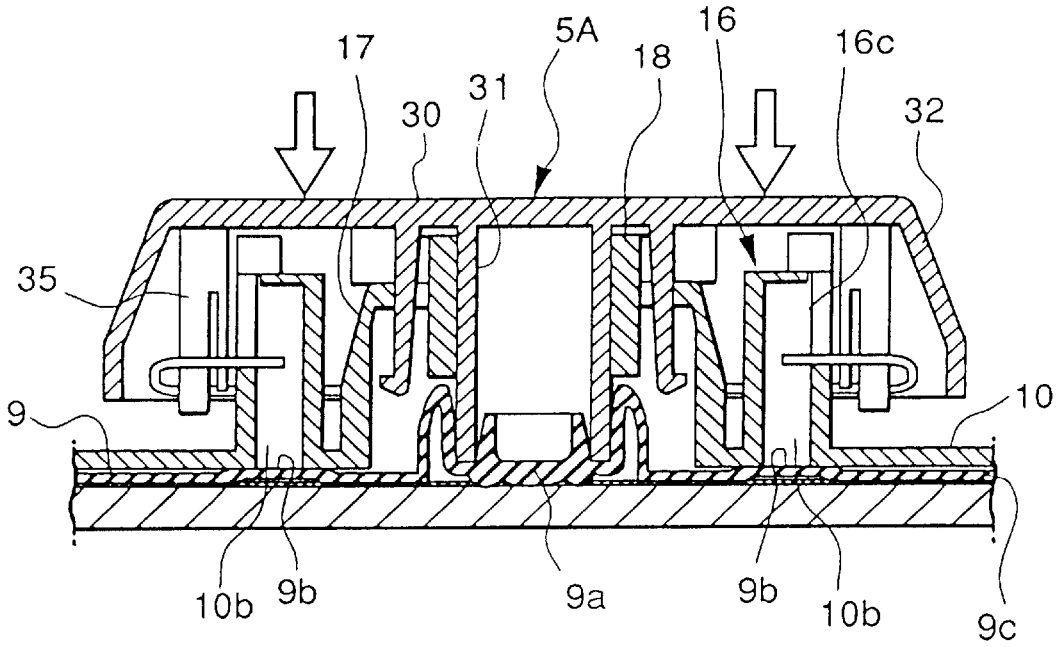
FIG. 6 is a diagram showing a depressed state of the key top of FIG. 4.
Figure 7:
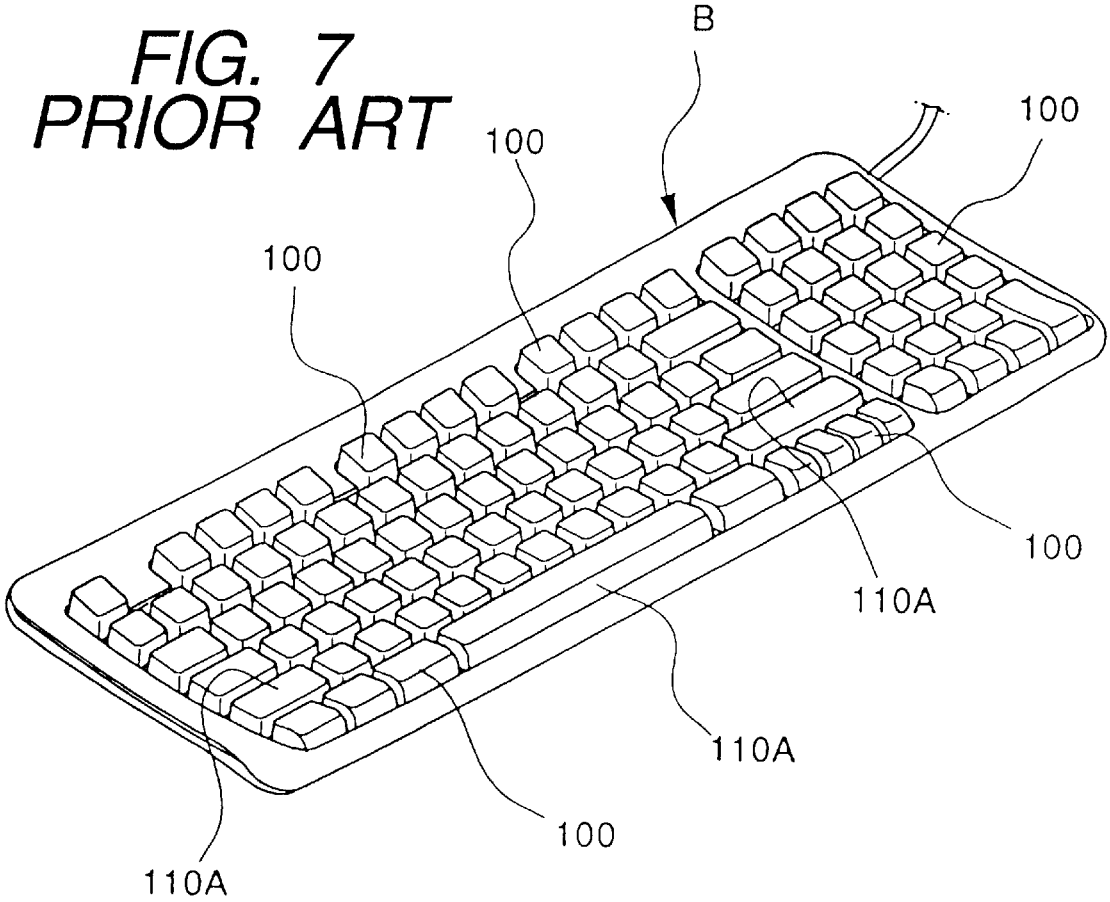
FIG. 7 PRIOR ART
FIG. 7 is a diagram showing an example of key top housing provided on the conventional keyboard device illustrated in FIG. 7 and each having a torsion bar.
Figure 8:
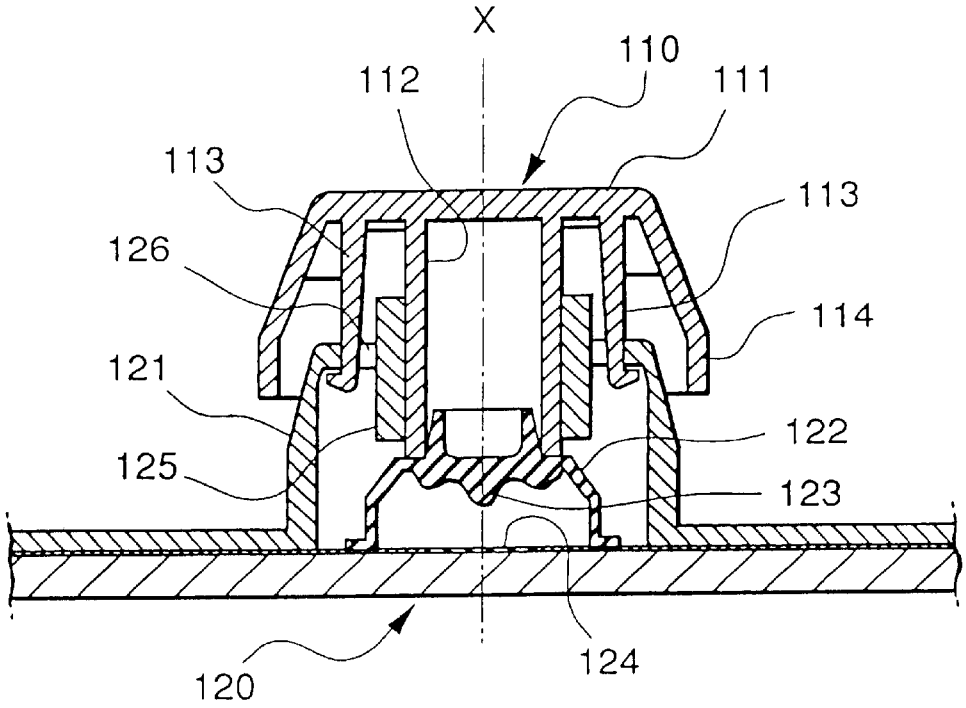
FIG. 8 PRIOR ART
FIG. 8 is a sectional view showing the structure of a conventional key top and key top housing portion not provided with a torsion bar, as well as the surrounding portion.
Figure 9:
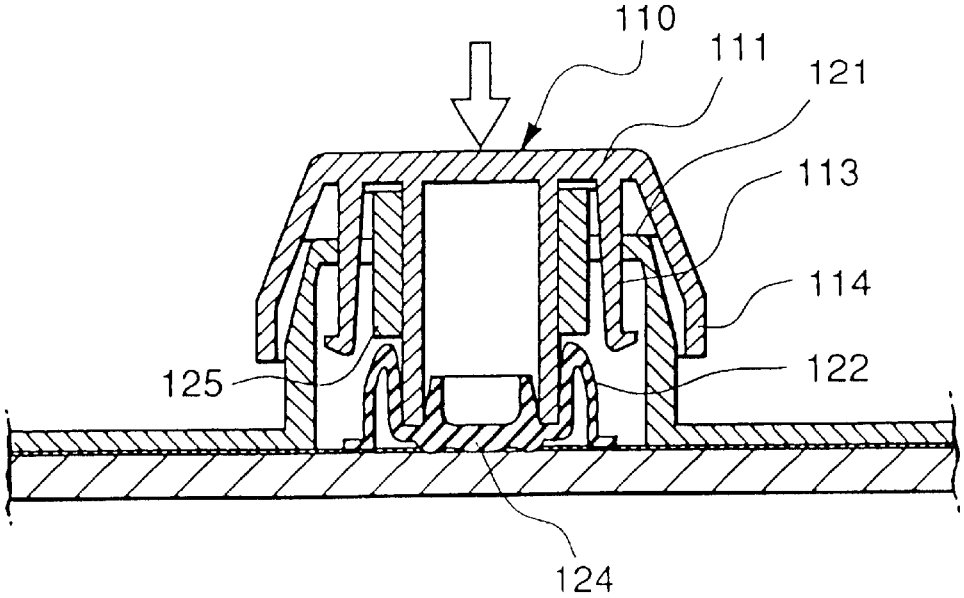
FIG. 9 PRIOR ART
FIG. 9 is a configuration diagram showing a depressed state of the key top illustrated in FIG. 8.
Figure 10:
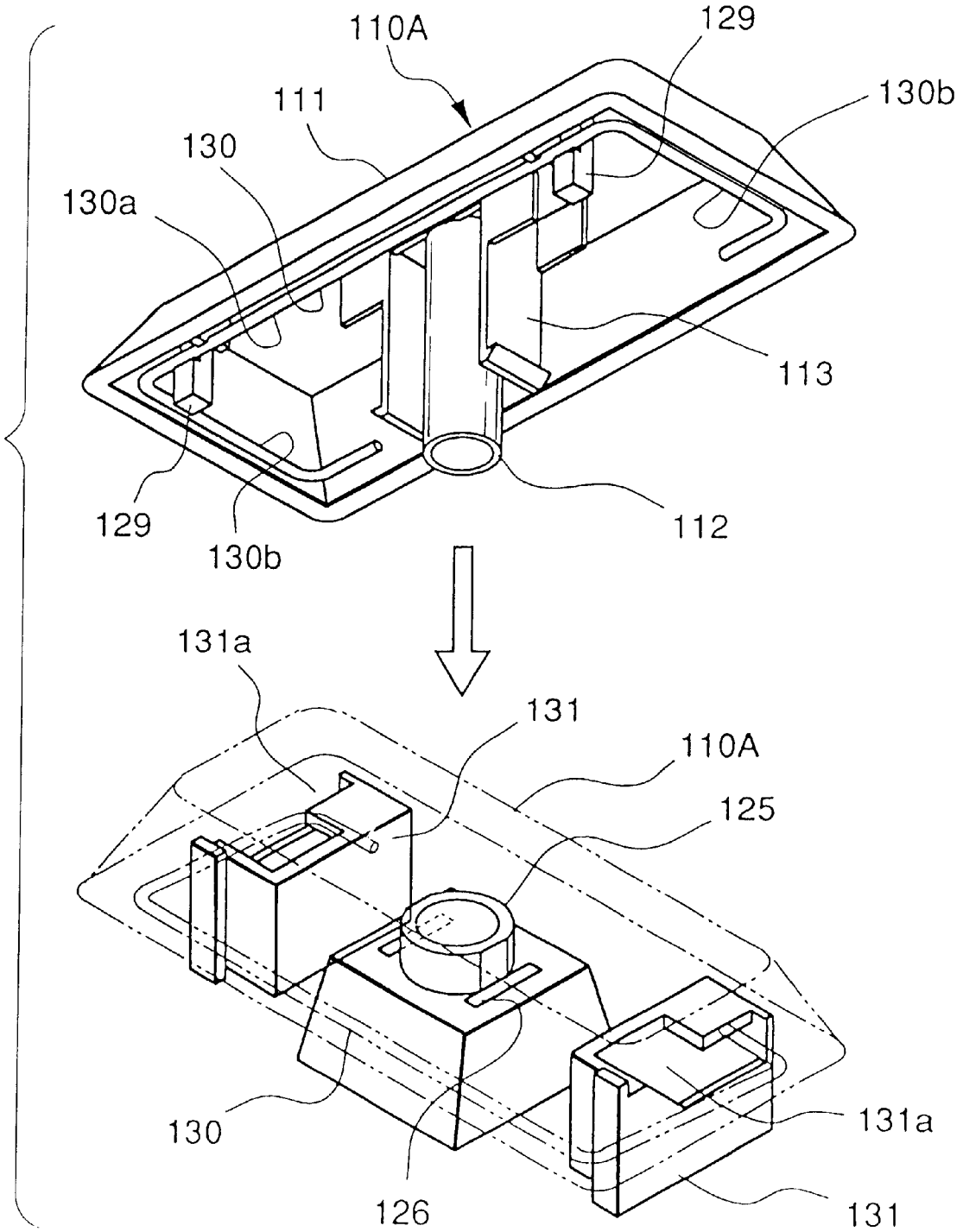
FIG. 10 PRIOR ART
FIG. 10 is a perspective view showing a key top provided with a torsion bar and a mounted state thereof.

When a user of the keyboard assembly A depresses the key top 5A configured as above with a finger as in FIG. 6, the stem portion 31 deforms and crushes the associated spring portion 9*a* of the sheet member 9 elastically, whereby the associated membrane switch 8 is depressed into conduction. Upon release of the user's finger from the key top 5A, the key top reverts to its original position with an elastic reverting force of the spring portion 9*a,* so that that membrane switch 8 turns OFF.

The portions of the retaining holes 16*c* formed on the upper end sides of the support members 16 in the keyboard assembly are generally disadvantageous from the waterproofing standpoint, but in the presence of the sheet member 9 having the above structure the opening portions of the through holes 10*b* formed on the base end sides of the support members 16 are closed with the underlying waterproofing protuberances, so that it is possible to enhance the waterproofness inside the support members 16.

Therefore, even in the event of erroneous spilling of water or a drink onto the keyboard, there is no fear of entry of the spilt water or drink to the interior side of the keyboard assembly, namely, to the membrane switch side having an electric circuitry. Although the pawl engaging holes 26 and the cylindrical inserting portion 18 in each housing projection 17 also have the respective opening portions, they pose no problem in point of waterproofness because they are covered with the top plate 20 (30) of the associated key top.

Thus, the keyboard assembly A of this embodiment having the above structure is superior in point of waterproofness around key portions.

According to the present invention, as set forth above it is possible to provide a keyboard assembly improved in waterproofness around key portions because the sheet member having waterproofing protuberances for closing opening portions of through holes formed in the housing plate under the support members is disposed under the housing plate.

Moreover, if the sheet member is a single sheet comprising spring portions, waterproofing projections, and sheet body portion, it covers the membrane switches from above and hence it is possible to completely prevent the entry of water from the key top side to the membrane switch side.

Further, if the waterproofing protuberances have a planar shape larger than the opening portion of each of the through holes referred to above so as to permit complete closing of the opening portion, it is possible to provide a keyboard assembly further improved in waterproofness.

Additionally, if the waterproofing protuberances are formed using the same rubber as that of the rubber spring portions, they can close the opening portions of the through holes in the housing plate completely in close contact with the opening portions, thus permitting the provision of a highly waterproof keyboard assembly.

What is claimed is:

1. A keyboard assembly comprising:

a support plate;

membrane switches formed on the support plate;

a housing plate disposed on the membrane switches; and key tops respectively supported vertically movably on a plurality of convex-shaped key top housings, the key top housings being arranged in rows on an upper surface side of the housing plate, wherein a torsion bar is attached to a back side of at least one of the key tops, support members of a hollow structure are erected on the housing plate on opposing sides of the key top housing which supports a key top with the torsion bar attached thereto, retaining holes to retain end portions of the torsion bar are formed respectively in upper portions of the support members, while on bottom sides of the support members are respectively formed through holes which extend through the housing plate and which are open to a bottom side of the housing plate, and a sheet member is disposed between the housing plate and the membrane switches, the sheet member comprising convex-shaped spring portions aligned respectively with the plural key top housings, convex-shaped waterproofing protuberances positioned respectively in opening portions of the through holes at opposing ends of the key top housing formed with the torsion bar to close the opening portions, a sheet body portion which renders the plural spring portions and the plural waterproofing protuberances integral with each other, and the waterproofing protuberances are larger than the opening portions of the through holes and cover an entirety of the opening portions.

2. A keyboard assembly according to claim 1, wherein the key top housings are of a hollow structure and have hollow portions contiguous respectively to insertion holes formed in the housing plate, and the spring portions of the sheet member pass respectively through the insertion holes and are inserted into the key top housings, the spring members imparting an upward reverting force to the key tops.

3. A keyboard assembly according to claim 2, wherein the spring portions are formed as rubber spring portions, and the rubber spring portions, the waterproofing protuberances, and the sheet body portion are rendered integral with one another using a same rubber.

4. A keyboard assembly in which a plurality of key top housings to support key tops are formed on a housing plate disposed below the key tops, post-like support members are formed sideways of each of the key top housings corresponding to the key tops to which torsion bars are attached respectively, out of the plural key top housings, the support members being erected integrally from the housing plate and having a hollow structure, through holes are formed respectively in base end portions of the support members to extend through the housing plate, and a sheet member is disposed on a back side of the housing plate, the sheet member comprising waterproofing protuberances to close the through holes in a waterproof manner, spring portions to push back the key tops upward, and a sheet body portion which makes the spring portions and the waterproofing protuberances integral with each other;

wherein the waterproofing protuberances have a planar shape larger than an opening portion of each of the through holes so that the waterproofing protuberances can each cover a whole of the opening portion.

5. A keyboard assembly according to claim 4, wherein the key top housings are of a hollow structure and have hollow portions contiguous respectively to insertion holes formed in the housing plate, and the spring portions of the sheet member pass respectively through the insertion holes and are inserted into the key top housings, the spring members imparting an upward reverting force to the key tops.

6. A keyboard assembly according to claim 5, wherein the spring portions are formed as rubber spring portions, and the rubber spring portions, the waterproofing protuberances, and the sheet body portion are rendered integral with one another using a same rubber.

* * * * *

UNITED STATES PATENT AND TRADEMARK OFFICE

CERTIFICATE OF CORRECTION

PATENT NO. : 6,239,391 B1
DATED : May 29, 2001
INVENTOR(S) : Akio Nishijima et al.

It is certified that error appears in the above-identified patent and that said Letters Patent is hereby corrected as shown below:

Title page,
Foreign Application Priority Data,
Line 1, delete "Apr. 6," and substitute -- June 4, -- in its place.

Signed and Sealed this

Nineteenth Day of March, 2002

*Attest:*

*Attesting Officer*

JAMES E. ROGAN
*Director of the United States Patent and Trademark Office*